US005238241A

United States Patent [19]

Christensen

[11] Patent Number: 5,238,241

[45] Date of Patent: Aug. 24, 1993

[54] BATTING PRACTICE DEVICE

[76] Inventor: Randall B. Christensen, 1550 33rd St., Ogden, Utah 84403

[21] Appl. No.: 905,352

[22] Filed: Jun. 29, 1992

[51] Int. Cl.[5] ..... A63B 69/40

[52] U.S. Cl. ..... 273/26 E; 273/200 R

[58] Field of Search ..... 273/29 A, 26 E, 184 B, 273/185 C, 200 R, 196, 197 R

[56] References Cited

U.S. PATENT DOCUMENTS

| | | | |
|---|---|---|---|
| 3,214,166 | 10/1965 | Gaudet | 273/26 E |
| 3,502,337 | 3/1970 | Butkus | 273/200 R |
| 3,731,925 | 5/1973 | Cardwell | 273/26 |
| 3,907,287 | 9/1975 | Fox | 273/26 |
| 4,687,209 | 8/1987 | Carey | 273/411 |

FOREIGN PATENT DOCUMENTS

| | | | |
|---|---|---|---|
| 21210 | 2/1936 | United Kingdom | 273/29 A |

*Primary Examiner*—Theatrice Brown

*Attorney, Agent, or Firm*—A. Ray Osburn

[57] ABSTRACT

A ball batting practice device wherein a practice ball is swung in an orbit at the end of a tether, having a elastic shock-absorbing link and a non-elastic link having a length greater than the elastic link, and placed in parallel with the elastic link. An easily grasped and retained hand-gripping assembly is attached at another end of the tether.

3 Claims, 3 Drawing Sheets

BATTING PRACTICE DEVICE

BACKGROUND OF THE INVENTION

1. Field

This invention relates generally to apparatus for games and more particularly to devices for practicing the batting of a baseball, softball or the like.

2. State of the Art

The games of baseball and softball are quite popular with many individuals, but both generally require assembling a number of interested players to conduct meaningful practice, especially for batting. Several prior art devices hurl balls past the practicing batter, one after the other, but are economically prohibitive to most recreational players. Less elaborate devices are based upon swinging a practice ball secured to an elongate flexible tether. An assistant propels the ball in an orbital path passing through the practice batter's strike zone. In many of these devices, the tether cord is attached to an elongate wand, which is manipulated in a circular pattern above the head to maintain the attached ball in its orbital path. The leverage of the wand is very tiring to the shoulder, hand and arm, and control is difficult to maintain. Devices incorporating wands are found in U.S. Pat. Nos. 2,942,883 and 4,415,155, in which the wands are manipulated by a single hand. Other devices incorporate short hand grips with swivels for tether attachment, as in U.S. Pat. No. 3,367,209. The shortened hand piece reduces but does not eliminate the leverage on the hand, which must still resist a wrenching, dislodging force.

More complicated devices require the use of two hands on separate tether control handles. U.S. Pat. No. 4,032,145, for example, discloses an upper handle through which the tether slides, and a lower "T" handle at the end of the tether. This allows the path of the ball to be jiggled to simulate curves, and inside and outside pitches.

When the ball is struck, its direction of flight reverses, the cord slakens and then re-tensions, tending to severely shock the holding hand of the user. Similar, often more severe, shock results when the inaccurately swung bat entangles with the ball end of the tether. To absorb such shocks, U.S. Pat. No. 3,907,287 incorporates a metallic tension spring linking the tether to the handle, an arrangement which is satisfactory for the perforated lightweight shell ball employed. For heavy baseballs or softballs, such springs vibrate and rebound violently. U.S. Pat. No. 3,731,925 incorporate a compression spring interposed between upper and lower hand grips of a two-handed holding arrangement. Upon release of the lower grip, the tether cord slides through an associated wand, until the lower grip is stopped by impact with the compression spring. Attendant vibration is undoubtedly quite severe.

A need therefore remains for an improved batting practice device utilizing an orbiting tethered ball, with more effective batted ball shock absorption and less stressful gripping provisions.

BRIEF SUMMARY OF THE INVENTION

The present invention eliminates or substantially alleviates the foregoing disadvantages in present batting practice devices employing an orbiting tethered practice ball. An elongate, non-extensible, tether cord segment distant from the operator carries a ball secured to its outermost end, and is joined through an elongate elastic shock-absorbing link to another non-extensible segment, which in turn joins a handle means grasped by the operator. A third inelastic, shunt, segment spans the elastic link, and is long enough to allow elastic absorption of the shock of the batted ball, but short enough to prevent it from stretching beyond its breaking point. Should the elastic nevertheless rupture, the ball remains safely tethered by the link.

Preferably, the tether incorporates a portion in the form of a "Y", with equal length branches attached to the upper and lower ends of a handle grip. This assures that the vertically held handle pulls evenly against the fingers rather than twisting against the hand as occurs with tethers connected only at one end of the handle. This permits the ball to be orbited at the end of the tether by a rotational movement of the wrist, without entanglement or wrenching free from the hand.

It is therefore the principal object of the invention to provide a safe tethered ball batting practice device with improved shock absorption, providing reduced strain to the hand and arm of the operator.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
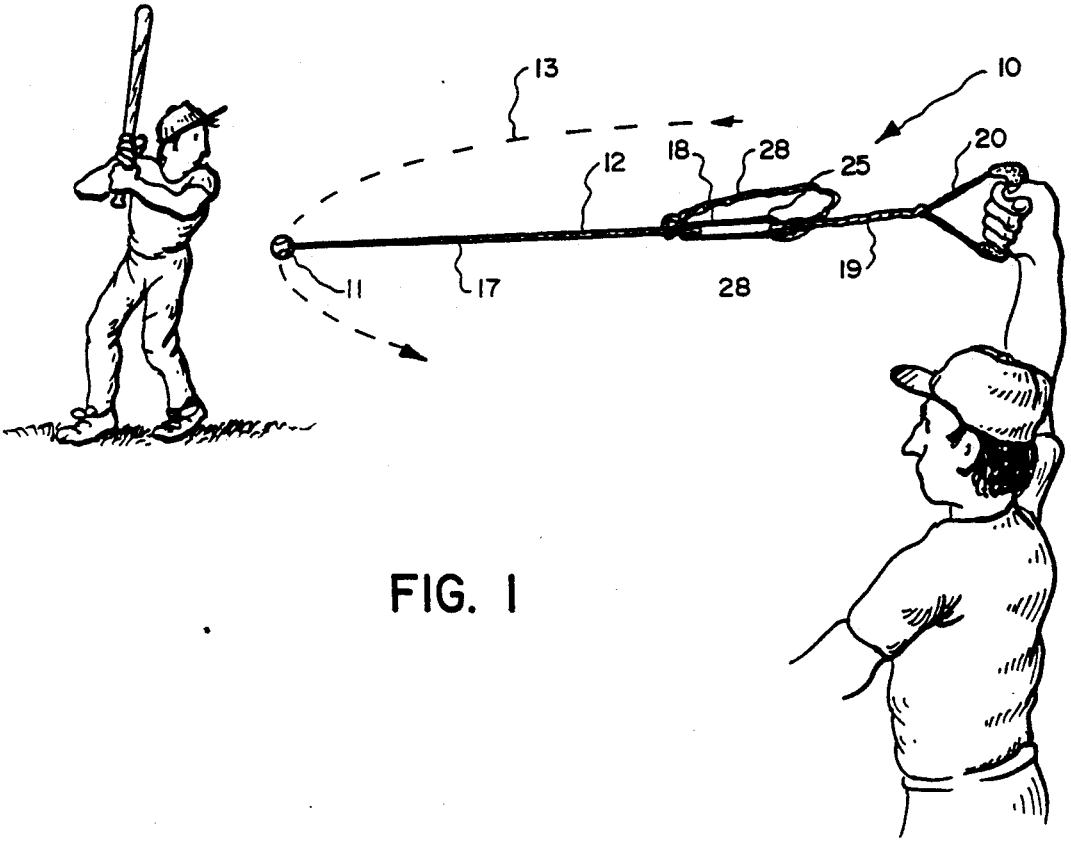
FIG. 1 is a representation of a ball batting practice device in accordance with the invention being used by an operator to propel the ball in an orbit through the strike zone of a batter, drawn to a reduced scale, FIG. 2 a fragment of the device of FIG. 1 at the ball connected end of the tether thereof, drawn to approximately full scale, FIG. 3 a drawing of a fragment of the device of claim 1 being the handle end of the tether thereof, itself shown fragmentally, drawn to substantially full scale, and FIG. 4 a fragment of the tether of FIG. 1 comprising the elastic shock-absorbing link thereof, drawn to substantially full scale.
Figure 2:
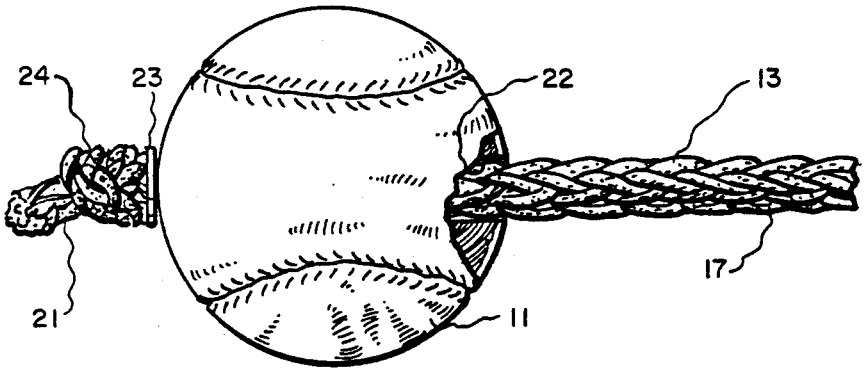

In FIG. 1, the tethered orbiting ball batting device 10 is shown operated by an athlete acting as a pitcher for a practicing batter. The pitcher rotates the ball 11, secured to a flexible tether assembly 12, in an orbit 13 in a plane above his head, grasping handle assembly 14. The orbit 13 is oriented to pass ball 11 through the strike zone of the batter. The length of tether 12 is selected to be about 12 feet, so that orbital path 13 is large enough for the path of ball 11 to reasonably simulate that of a conventionally thrown straight ball. By combining the arm and wrist motions, the pitcher can cause the ball to simulate inside and outside, and high and low pitches, curves and dips.

Tether assembly 12 comprises an outermost segment 17 connected through a shock arrest assembly 18 to an inner segment 19 in turn secured to a handle assembly 20. A conventional baseball or softball may be utilized for practice ball 11, fastened to the outer end 21 of tether segment 17 by any means not substantially obstructing the surface of the ball for batting. The end of segment 17 is threaded through a diametral bore 22 and retained against a washer 23 by a knot 24.

This method of attachment largely preserves the structural integrity and strength of ball 11, to withstand repeated blows of the bat.

When ball 11 is solidly struck by the bat, its direction of flight is abruptly reversed, and it may be momentarily propelled into free flight with tether assembly 12 in slack condition. Recapture of ball 11 by tether 12 transmits considerable shock to the hand and arm of the operator, alleviated however by shock absorber 18. In other instances, the bat becomes entangled with segment 17 of tether 12, creating a still more severe impact shock to the operator. Non-metallic shock arrester assembly 18 comprises a continuous elastic band 25 engaged by end loops 26 and 27 of tether inside and outside segments 19 and 17 respectively. Band 25 is relatively short, about 12 inches, so as to not stretch excessively to interfere with control of orbit 13. In operation however, it has proven to effectively protect the arm and hand from severe shock. Further, it adds no debilitating and jarring vibration itself, as is associated with metallic springs. Over extension and possible rupture of band 25 is prevented by an inelastic shunt cord 28 spanning between loops 26 and 27.

Figure 4:
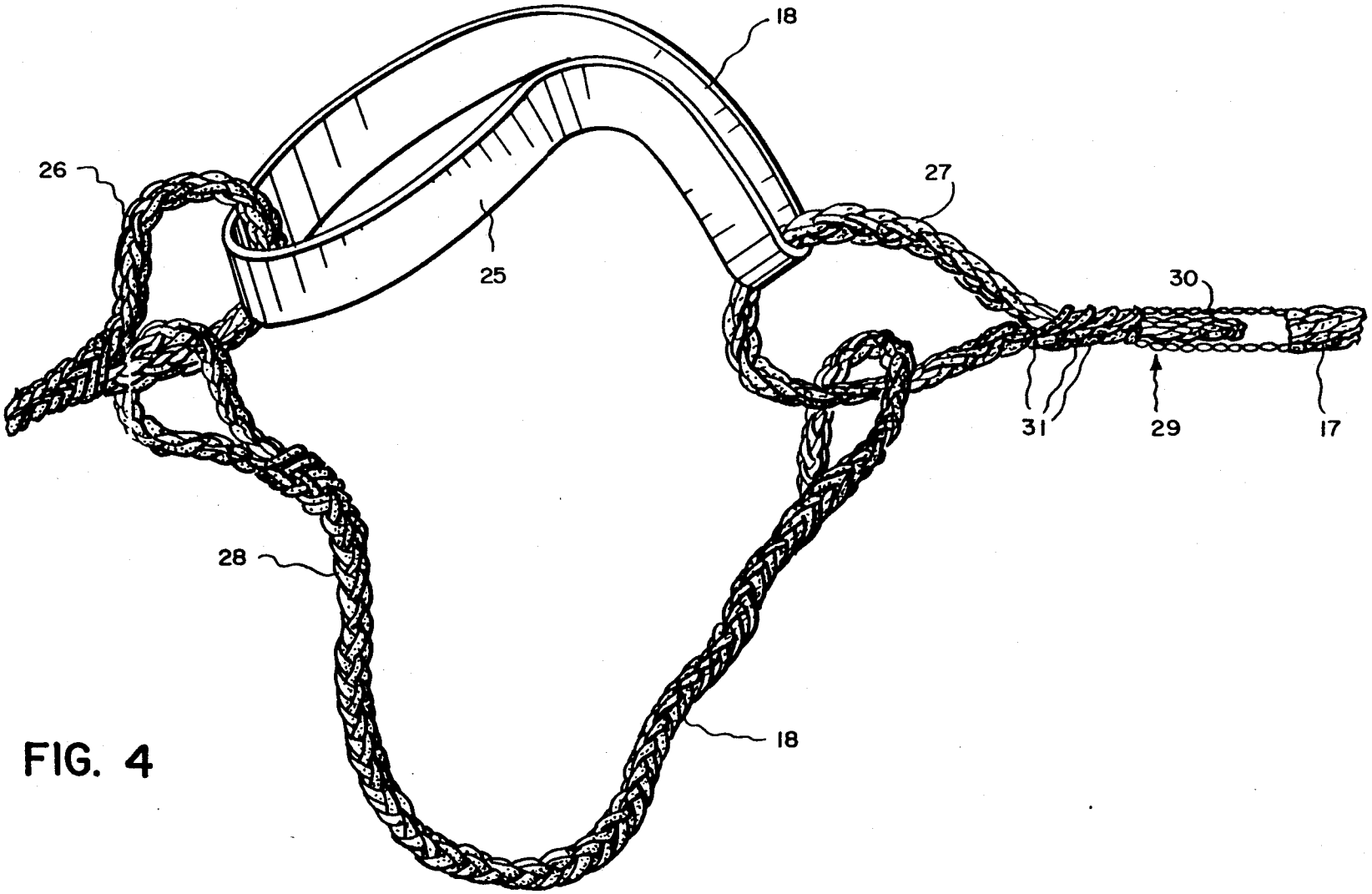

To provide smooth, aesthetically pleasing segment and shunt loops, spirally braided hollow cords are utilized. Such braided cords have the property of constricting diametrically to grip interior objects when cords are placed under longitudinal tension. Conversely, they expand and loosen diametrically when compressed longitudinally. To construct a loop, a portion 29 of the cord is expanded by compressing, and an end portion 30 is constricted by tension so that it may be inserted between braid strands 31. (FIG. 4) Subsequent application of tension tightens the strand 31 about the cord end portion. For replacement of elastic bands 25, for example, the the loop joint may be disassembled by again compressing the cord portion 29, in this event to loosen and extract the inserted end portion 30.

Figure 3:
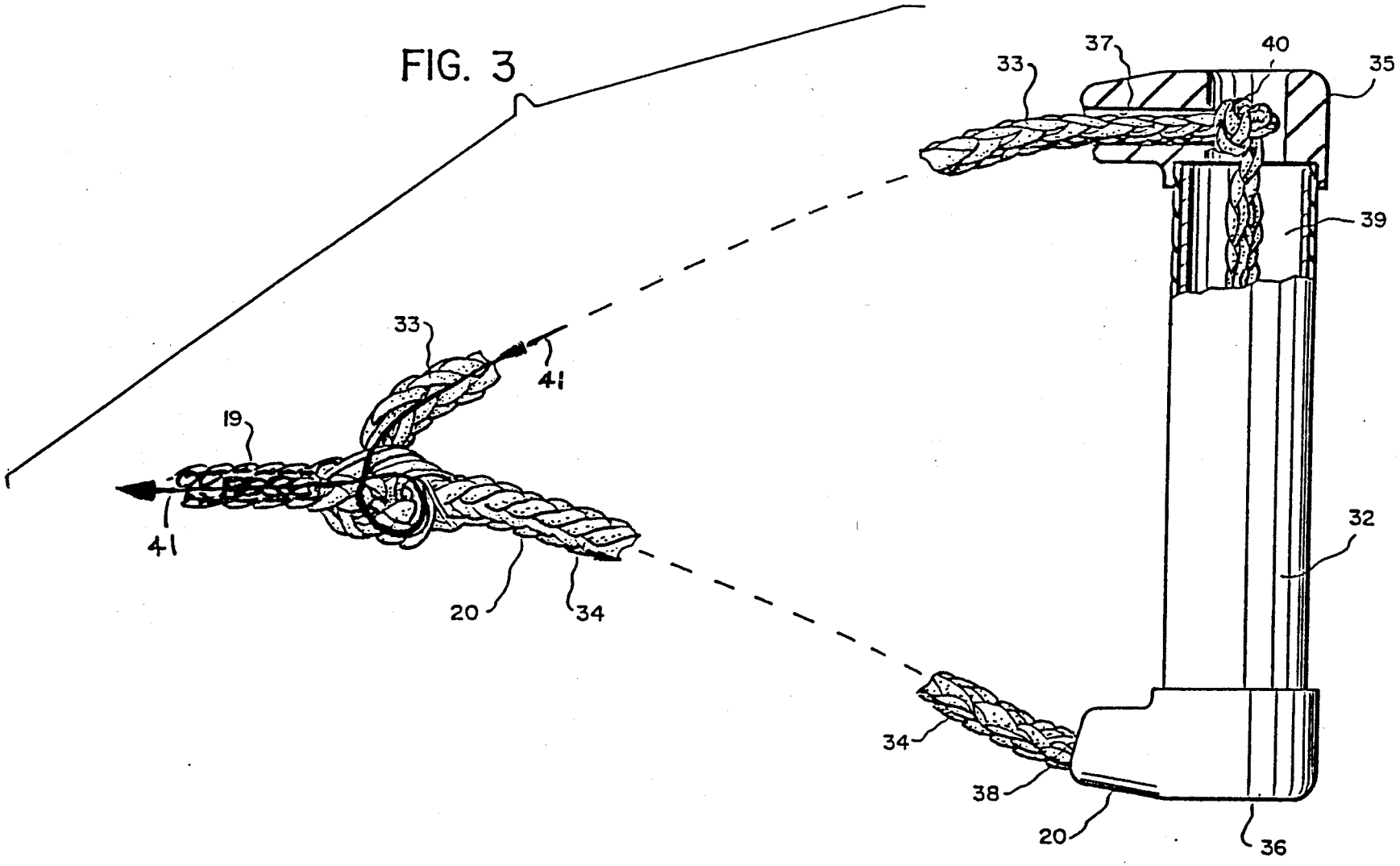

A major shortcoming in prior art tether ball devices is the lack of adequate gripping handles for the operator. The prior art devices typically provde only a short (or long) in the case of the wands, handgripping device joining the tether at only one end, so that it is severely wrenched and twisted in the hand, especially under the shock conditions described above. Tether ball device 10 incorporates a handle assembly 20 similar to that employed with tow ropes used for water skiing. The two sports have little in common, and the ropes are used in very different ways, but this serious disadvantage in prior art tether ball devices is unexpectedly eliminated with this type of handle. The handle grip member 32 is secured to upper and lower branches 33 and 34 provided at the near end of inner tether segment 19. (FIG. 3) This arrangement equalizes tensile forces applied to top and bottom ends 35 and 36 of grip assembly 14 into two tensile forces carried by the upper and lower branches. Therefore, the tension in the tether assembly 12 with this handle arrangement exerts evenly distributed force upon the gripping hand and fingers, without any twisting moment. An end portion of inside tether cord 19 is threaded through top and bottom holes 37 and 38, and vertical passage 39, in gripping member 32, secured against slipping by a pair of knots 40. Again, the branches 33 and 34 are preferably created by telescopic joinder of portions of tether cord 19 as previously described for the other loops. However, for still greater joint strength, the designer may first thread the free end entirely through the braid strands 31, before finally inserting it into the hollow braid center. See looped arrow 41, FIG. 3.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description, and all changes that come within the meaning and range of equivalency of the claims are, therefore, intended to be embraced therein.

What is claimed and desired to be secured by United States Letters Patent is:

1. A ball batting practice device comprising:

a ball suitable for batting;

an elongated tether assembly comprising a non-elastic flexible cord having ends proximate and distal to an operator of said device;

means securing a ball to said distal end and handle means secured to said proximate end and graspable by an operator, so that by above the head rotation of the hand and arm of an operator said ball is propelled in an orbital path through the strike zone of a batter; said tether assembly further comprising; innermost and outermost cord segments, said cord segments being joined by an elastic shock-absorbing means and an elongated non-elastic cord segment; said shock-absorbing means being an endless band of elastic material and said non-elastic cord segment having a length greater than one half the length of said endless band, said elastic band and said non-elastic cord segment being separately attached to one end of said innermost and outermost cord segments, such that when said endless band is stretched a predetermined distance said non-elastic cord segment will be tensioned to absorb any additional tension exerted on said tether assembly; said endless elastic band being attached to said one end of said innermost and outermost cord segments by extending a continuous loop formed in said one end of each said innermost and outermost cord segments through the loop of said endless band and said non-elastic cord segment having a continuous loop at each said end thereof, the loop at one end of said non-elastic cord passing through said continuous loop at said one end of said innermost cord segment and the loop at the other end of said non-elastic cord passing through said continuous loop at said one end of said outermost cord segment.

2. The device of claim 1 wherein:

said handle means is a rigid tubular member; said other end of said innermost cord segment passing through said tubular member and being attached to said innermost segment at a location remote from said end to form a handle loop, thus forming a hand grip at said proximate end of said tubular member from sliding thereon.

3. The device of claim 1 wherein:

the cord segments of said tether assembly are constructed of spirally braided strands in such a manner that said segments are hollow, and said loop at the end of each segment is formed by telescopic insertion of one end of the cord between the strands of the braid into the hollow interior thereof.

* * * * *